US006837035B2

(12) United States Patent
Schuller et al.

(10) Patent No.: US 6,837,035 B2
(45) Date of Patent: Jan. 4, 2005

(54) OPENING CYLINDER FOR AN OPEN-END SPINNING DEVICE

(75) Inventors: Edmund Schuller, Ingolstadt (DE); Eva-Maria Greppmair, Gachenbach (DE); Werner Strasser, Steckborn (CH)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 30 days.

(21) Appl. No.: 10/389,366

(22) Filed: Mar. 14, 2003

(65) Prior Publication Data

US 2004/0016222 A1 Jan. 29, 2004

(30) Foreign Application Priority Data

Mar. 15, 2002 (DE) ..... 102 11 622

(51) Int. Cl.[7] ..... D01H 4/32
(52) U.S. Cl. ..... 57/408
(58) Field of Search ..... 57/404, 408–413; 19/114; 492/30–37, 48; 140/97

(56) References Cited

U.S. PATENT DOCUMENTS 4,435,953 A 3/1984 Schmid et al.
RE33,190 E * 4/1990 Stahlecker ..... 57/408
5,318,497 A * 6/1994 Aarnink et al. ..... 492/30
5,794,311 A * 8/1998 Schuller et al. ..... 19/112
5,943,854 A 8/1999 Schuller et al.

FOREIGN PATENT DOCUMENTS

DE 19601036 7/1997

OTHER PUBLICATIONS

German Patent Office Search Report, Jul. 8, 2002.

* cited by examiner

*Primary Examiner*—John J. Calvert
*Assistant Examiner*—Shaun R Hurley
(74) *Attorney, Agent, or Firm*—Dority & Manning

(57) ABSTRACT

For the design of an opening cylinder (1) for an open-end spinning device where the opening cylinder (1) has a face (11), it is proposed that the base body (12) of the opening cylinder (1) be located on the end of a shaft (2) away from the bearing (21), whereby an axial distance (9) exists between the base body (12) and the bearing (21). To expose the gap (22) for maintenance purposes, the clothing holder (3) is designed so as to be removable in the axial direction across the bearing (21), whereby the face (11) towards the bearing (21) is formed on the clothing holder (3).

14 Claims, 2 Drawing Sheets

OPENING CYLINDER FOR AN OPEN-END SPINNING DEVICE

BACKGROUND

The present invention relates to an opening cylinder of an open-end spinning device having a base body containing at least parts of a face of the opening cylinder, over which the opening cylinder is installed on a shaft that is supported in a bearing for rotatable support of the opening cylinder, with a clothing holder containing at least part of a face of the opening cylinder, whereby the base body is located on the side of the shaft away from the bearing and whereby an axial distance exists between the base body and the clothing holder, producing a gap extending in a radial direction.

Opening cylinders are used with open-end spinning devices to prepare the fibers to be spun by detaching the fibers from a fiber sliver. To achieve this, the fiber sliver is fed into an opening cylinder housing in which it is opened into individual fibers by an opening cylinder provided with teeth or needles. In this process, the opening cylinder rotates at high speed. The individual fibers are then conveyed through a fiber channel from the housing of the opening cylinder to a spinning element, e.g. a spinning rotor.

To ensure the ability of the opening cylinder to rotate, it is installed on a shaft that is supported by a bearing. During the operation of the opening cylinder, the bearing is exposed to dust and fiber fly that is practically always present in a spinning installation. For this reason, the state of the art has already configured opening cylinders in such manner that their bearings are accessible, in particular for inspection and cleaning purposes.

DE 31 23 480 discloses an opening cylinder having a base body on which a combing clothing is pushed and fastened by means of a clamping mechanism. When the combing clothing support is removed from the base body, the area of the bearing can be inspected through radial bores going through the base body. In another embodiment, the opening cylinder has a separately installed face located on the outer ring of the bearing. The first embodiment of the opening cylinder shown here allows access to the interior of the base body, but the bearing itself is practically inaccessible because only a very narrow gap is left between the base body and the outer ring of the bearing, and besides, access is possible only through the bores.

The other embodiment has the disadvantage that the clothing support must be made at the same time so as to fit exactly with the base body as well as the face toward the bearing. The latter can be mounted by means of a fit to the outer ring of the bearing and is at a distance from the clothing ring, as the surface toward the bearing does not rotate together with the clothing ring. Furthermore, this embodiment has the disadvantage that the base body and the outer ring of the bearing are barely at a distance from each other, so that cleaning of the interior of the opening cylinder appears to be easy in principle, but not near the bearing. In particular, the not rotating face toward the bearing furthermore causes the production of this opening cylinder and the disassembly of the clothing ring to be expensive.

SUMMARY

It is a principal object of the present invention to design an opening cylinder in such manner that the disadvantages of the state of the art are avoided and good cleaning of the bearing and of an area across from it is possible, whereby the opening cylinder is at the same time made in several parts, so that the clothing can easily be replaced when it is worn out. Additional objects and advantages of the invention will be set forth in part in the following description, or may be obvious from the description, or may be learned through practice of the invention.

The objects are attained by an opening roller designed according to the invention wherein, in order to bare the gap or an area of the base body across from it, the clothing holder is designed so as to be removable in the axial direction across the bearing and in that the clothing holder supports the face towards the bearing. Thanks to the opening cylinder designed according to the invention, a maintenance worker is able to easily clean fibers or grease deposited in the area of the bearing and, if the base body extends beyond the gap, in this extended area. Also, an opening cylinder designed according to the invention can be produced and mounted economically and easily. Here, the clothing holder can advantageously be pushed in the direction across the bearing, away from the base body of the opening cylinder, and the clothing holder together with the clothing support can be pushed toward the bearing in order to make the gap accessible, whether the clothing holder and the clothing support are made in one piece or in several pieces. Due to the fact that the clothing holder holds at the same time the face toward the bearing, it can be attached advantageously on the opening cylinder and rotates together with the clothing, so that it does not move in relation to the clothing.

In art especially advantageous further development of the invention, the opening cylinder is made with a stop for the clothing holder, whereby the stop acts in the axial direction and is located on the base body. On it, the clothing holder comes to lie against the base body in the axial direction. The clothing holder can also be stopped advantageously via the clothing support, whereby the clothing support contacts a stop of the base body in axial direction. The clothing holder can advantageously be disassembled from the base body so that it can be removed for the replacement of the clothing. It is especially advantageous if the clothing holder is attached for that purpose with fastening means to the base body of the opening cylinder.

In an advantageous further development of the invention, the fastening means for the clothing holder is itself located at least in part on the base body. For this purpose, the fastening means is advantageously made in the form of threads on the base body, whereby the clothing holder itself advantageously supports the corresponding part of the threads, so that the two can be attached together and so that the corresponding parts of the threads are the fastening means located on them.

In an advantageous further development of the invention, the fastening means is made in the form of a bore in the base body or the clothing holder, whereby the bore is advantageously provided with threads. In this manner, the clothing holder can easily be attached to the base body, e.g. by means of screws. A fastening means in the form of clip-on connection between the base body and clothing holder is especially advantageous. Especially easy assembly and disassembly of the clothing holder or clothing support can thus be effected on the base body. For this, the clip-on connection advantageously exerts a force in the direction of the base body. This ensures secure connection between the two components.

In an advantageous further development of the invention, the minimum width of the gap between the base body and the bearing is 1.5 mm. An embodiment in which the gap's smallest width is 2.5 mm is especially advantageous. The gap's maximum width is advantageously 19 mm, and a width of 9 mm is especially advantageous. The height of the gap is here advantageously less than 16 mm. Advantageous further developments of the invention are set forth in the claims and can be understood from the description and the drawings of the invention.

DETAILED DESCRIPTION

Figure 1:
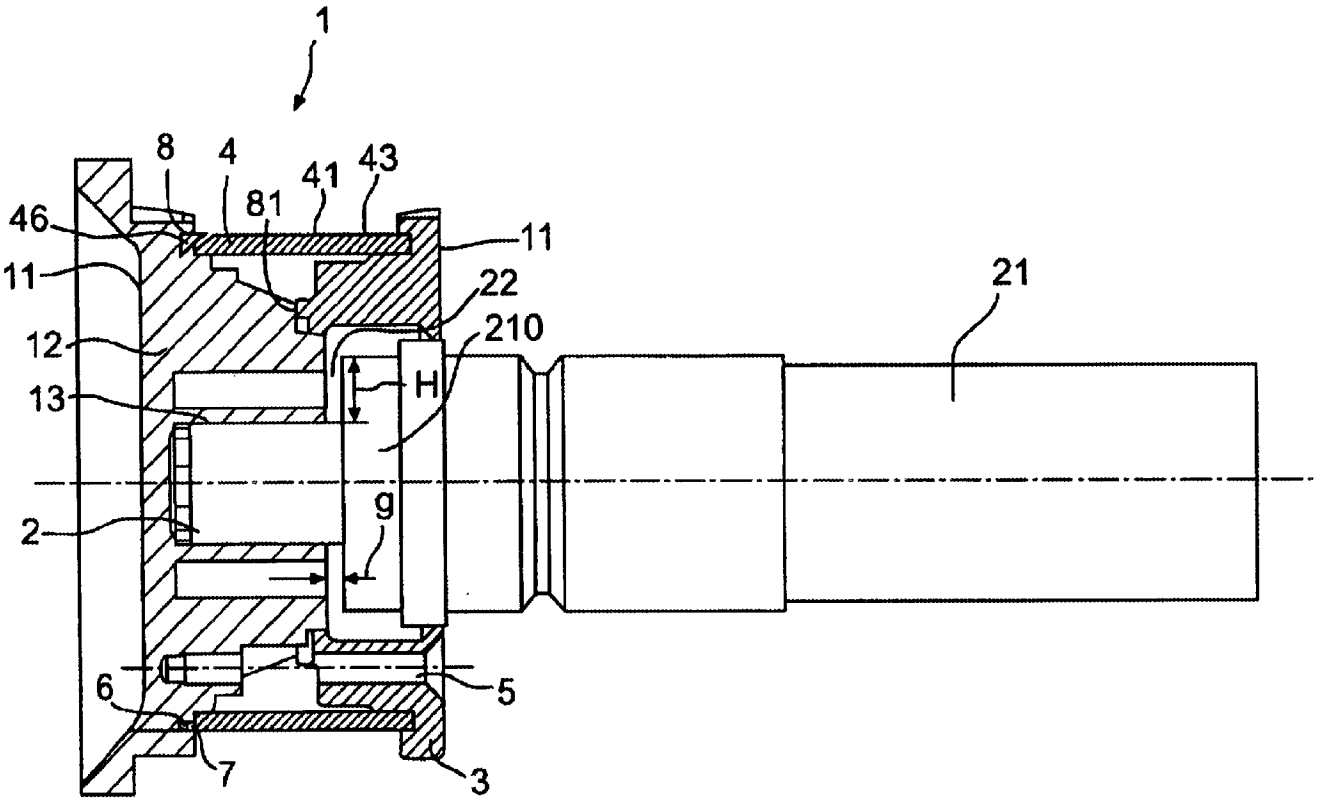
FIG. 1 shows a section through an opening cylinder with bearing, where the clothing holder and the clothing support are separate components.

Reference is now made to particular embodiments of the invention, examples of which are shown in the drawings. Each embodiment is provided by way of explanation of the invention, and not as a limitation of the invention. The invention includes modifications and variations to the embodiments described herein.

The longitudinal section of the opening cylinder 1 of FIG. 1 according to the invention shows its structure and position for rotatable support on the bearing 21. The opening cylinder 1 consists of a base body 12 that is attached by means of a force fit on the shaft 2 on the side away from the bearing 21. The shaft 2 is supported by means of cylinder bearings that are not shown on the shaft 2, whereby the bearing sleeve 210 on the right side of the base body 12 is the outer ring of a cylinder bearing and does not rotate together with the opening cylinder 1.

In addition to the base body 12, the opening cylinder 1 consists also of the clothing holder 3 which is attached by means of fastening means 5, in this case in the form of screws, to the base body 12. A ring-shaped clothing support 4 is located between the clothing holder 3 and the base body 12. The clothing support 4 is impinged on one side by the base body 12 and on the other side by the clothing holder 3.

The clothing support 4 in form of a ring 41 is stopped by the stop 8 of the base body 12 with its one edge 46 away from the bearing 21. If the clothing holder 3 and the clothing support 4 are made in one piece, the opening cylinder can also be made that way, i.e. so that the edge 46 of the clothing support 4 contacts the stop 8 of the base body 12. In case of a clothing holder 3 being in one piece with the clothing support 4, there is also the possibility for the clothing holder to be stopped by the inside stop 81 of the base body 12 directly. The ring 41 is provided on its outer circumference 43 with clothing consisting of teeth or needles [not shown].

In another advantageous embodiment of the invention, the base body 12 and the ring 41 are interlocked in the direction of the circumference. For this purpose, the edge 46 has an opening 7 in the area of its cylindrical inner wall, into which a projection 6 of the base body 12 extends. The projection 6 and the opening 7 thus produce a positive connection as seen in the circumferential direction of the opening cylinder.

Thanks to this positive connection produced by the opening 7 and the projection 6 between the clothing support 4 in form of a ring 41 and the base body 12, it becomes possible to absorb the forces produced by the opening of the fiber sliver and acting in the circumferential direction of the clothing support 4. Pressing the clothing support 4 in the axial direction on the base body 12 in order to achieve a non-positive connection is therefore not necessary. The joint between the clothing support 4 and the clothing holder 3 are preferably closed as much as possible in this process, so that no fibers may enter.

In mounting the clothing holder 3 and the clothing support 4, these are pushed in the axial direction across the bearing 21 on the base body 12. Due to the design of the base body with stop 8, a precise positioning of the clothing support 4 on the base body 12 is possible, also as seen in the axial direction. The clothing support 4 is held on the stop 8 through the fastening means 5 and the clothing holder 3, without having to provide for this any pre-stress acting in axial direction, if a positive connection exists between the base body 12 and the clothing support 4 in the circumferential direction.

The base body 12 is attached on the shaft 2 via the seat 13. The seat 13 and the shaft 2 constitute a compression joint so that a secure and strong connection is ensured between the base body 12 and the shaft 2. The shaft 2 is supported rotatably via the bearing 21 in roller bearings. The roller bearings are sealed in a known manner by means of sealing disks, but care must nevertheless be taken that the support is shielded against the influence of dirt. This is achieved with the opening cylinder 1 of FIG. 1 by the clothing holder 3 which sits on the base body 12 and forms a tight seal, as well as through the fact that only a very narrow gap 22 is left between the clothing holder 3 and the bearing sleeve 210. It may nevertheless be necessary to clean entering dirt from the area of the bearing, and for this purpose the gap 22 of the bearing 21 becomes easily accessible once the clothing holder 3 and the clothing support 4 have been removed. In removing the clothing holder 3, it as well as the clothing support 4 are pushed in the axial direction across the bearing 21 once the fastening means 5 have been loosened. If necessary, the clothing support 4 can then also be replaced by removing it completely together with the clothing holder 3 and inserting a new one.

Figure 2:
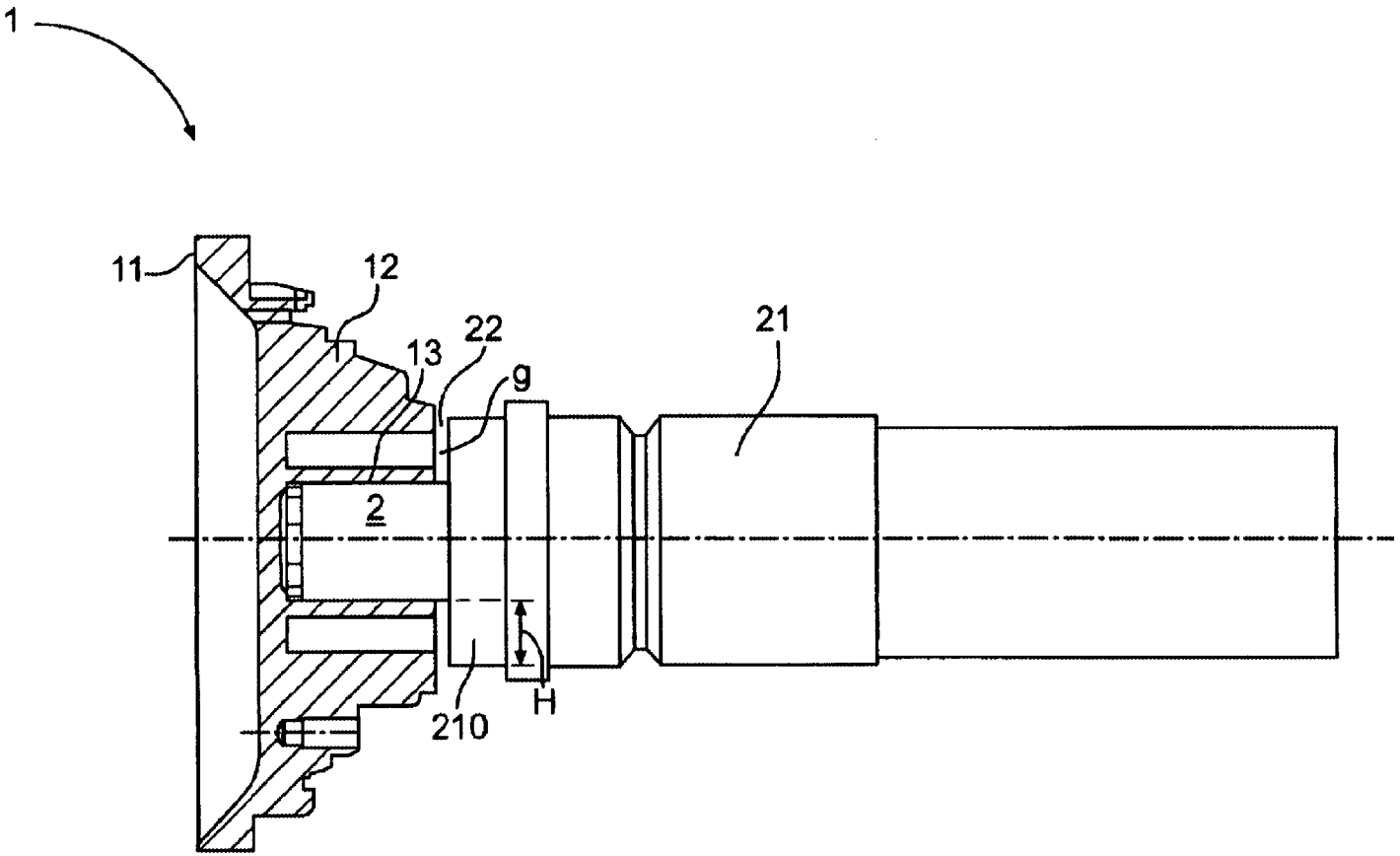
FIG. 2 shows the section of FIG. 1, without clothing holder and support.

FIG. 2 shows a representation that is similar to FIG. 1, but without clothing support and clothing holder. The base body 12 which is attached on the shaft by its seat 13 produces a gap 22 with the bearing sleeve 210 of bearing 21. Base body 12 and bearing sleeve 210 are here at a distance 9 from each other. In order to prevent the entry of dirt into the area between the base body 12 and the bearing sleeve 210, it could be attempted to reduce the distance 9 to a minimum. However, the utilization of the bearing in a spinning installation does not allow this. This is because fiber-containing dust is generated in yarn production that would not only overcome this narrow gap but would cause blockage of the moving parts at such narrow distance from each other. Nor does covering the gap 22 with the clothing holder 3 offer sufficient protection in order to prevent fibers from entering the gap 22. Although the clothing holder 3 is connected to the base body 12 of the opening cylinder in such manner that no fibers can penetrate, a small gap does exist between the clothing holder 3 and the bearing sleeve 210, since these two move in relation to each other.

By designing the base body 12 so that its face 11 is located on the side away from the bearing 21, it is possible to make the gap accessible in a radial direction. Due to the fact that the second remaining face 11 of the opening cylinder (see FIG. 1) is not formed by the base body 12 but by the clothing holder 3, the removal of the clothing holder 3 uncovers at the same time the gap 22. For disassembly, after loosening the fastening means, the clothing holder 3, whether made in one piece with the clothing support 4 or in two parts, is simply taken in the axial direction away from the base body 12 and over bearing 21, so that the gap 22 is freely accessible in the radial direction. For the embodiment in two parts, the ring 41 must of course also be pulled off the base body.

During the disassembly of the clothing holder and the clothing support 4, the opening cylinder 1 is in such position with its bearing 21 on face 11 of the base body 12 that the operator requires no other device in order to handle the opening cylinder 1 during the replacement of the clothing or the cleaning of gap 22. With a design of the base body 12 and of the free end of the shaft 2, certain dimensions must be kept so that the base body 12 can be securely attached to the shaft 2 via its seat 13. This is achieved as already indicated previously, by means of a force fit. For a replacement of the clothing the base body must not be removed, so that once it is attached, it remains on the shaft 2 in spite of the replacement of the clothing.

For the dimensions of the gap width it has been shown that a value of approximately 4 mm provides sufficient access for cleaning. For the height of the gap it has been shown that for the above-mentioned width, a height of 13 mm still provides favorable conditions for the cleaning of the gap.

In addition to scrapers or brushes that make mechanical cleaning possible, compressed air can also be used and is then blown by a maintenance worker by means of a nozzle into the gap. As for the dimensions of the gap, for the width that is finally determined by the cleaning means, it is also necessary to provide a greater width for a greater height of the gap.

It should be apparent to those skilled in the art that modifications and variations can be made to the embodiments described herein without departing from the scope and spirit of the invention. It is intended that the invention include all such modifications and variations as come within the scope of the appended claims and their equivalents.

What is claimed is:

1. An opening cylinder for an open-end spinning device, comprising:

a base body defining a forward axial face of said cylinder;

a shaft supported in a bearing, said base body mounted onto said shaft such that said body and said shaft are rotatably supported by said bearing;

a clothing holder defining a rearward face of said cylinder, said clothing holder detachably connected with said base body;

an axially extending space defined between said base body and said bearing such that a gap is produced, said gap extending radially from said shaft; and wherein said clothing holder is detachable from said base body in an axial direction over said bearing so as to expose said gap for servicing.

2. The opening cylinder as in claim 1, further comprising a stop surface defined between said clothing holder and said base body to define a relative axial position of said clothing and said base body, said stop surface defined on said base body.

3. The opening cylinder as in claim 2, wherein said clothing holder further comprises an axially extending clothing support, said clothing support engaged against said stop surface of said base body.

4. The opening cylinder as in claim 1, further comprising a fastening mechanism operably disposed between said clothing holder and said base body, said fastening mechanism formed at least in part on said base body.

5. The opening cylinder as in claim 4, wherein said fastening mechanism comprises a threaded connection between said base body and said clothing holder.

6. The opening cylinder as in claim 4, wherein said fastening mechanism comprises a threaded bore defined in said base body, and a screw extending through said clothing holder and engaging in said threaded bore.

7. The opening cylinder as in claim 4, wherein said fastening mechanism comprises a clip-on connection.

8. The opening cylinder as in claim 7, wherein said clip-on connection exerts an axial force on said clothing holder in the direction of said base body.

9. The opening cylinder as in claim 1, wherein said gap has a width in the axial direction of equal to or less than about 2.5 mm.

10. The opening cylinder as in claim 9, wherein said gap has a width in the axial direction of about 1.5 mm.

11. The opening cylinder as in claim 1, wherein said gap has width in the axial direction of not greater than about 19 mm.

12. The opening cylinder as in claim 4, wherein said gap has a width in the axial direction of about 9 mm.

13. The opening cylinder as in claim 1, wherein said gap has a width in the axial direction of between about 1.5 mm to about 19 mm.

14. The opening cylinder as in claim 1, wherein said gap has a height measured radially from said shaft of not greater than about 16 mm.

* * * * *